US006241463B1

(12) United States Patent
Bahner et al.

(10) Patent No.: US 6,241,463 B1
(45) Date of Patent: Jun. 5, 2001

(54) METHOD FOR DETERMINING THE OPERATING LEVEL OF A FAN AND FAN

(75) Inventors: Friedrich Bahner, Rotenburg; Norbert Eichhorn, Bad Hersfeld; Wilfried Möller, Friedewald, all of (DE)

(73) Assignee: Babcock-BSH GmbH, Bad Hersfeld (DE)

( * ) Notice: Subject to any disclaimer, the term of this patent is extended or adjusted under 35 U.S.C. 154(b) by 0 days.

(21) Appl. No.: 09/102,462

(22) Filed: Jun. 22, 1998

(30) Foreign Application Priority Data

Jun. 23, 1997 (DE) ..... 197 26 547

(51) Int. Cl.[7] ..... F01B 25/00

(52) U.S. Cl. ..... 415/17; 417/30; 417/47; 417/26

(58) Field of Search ..... 415/1, 13, 17, 415/26, 27, 30, 47, 118

(56) References Cited

U.S. PATENT DOCUMENTS

| | | | | |
|---|---|---|---|---|
| 3,292,846 | * | 12/1966 | Harper et al. | 415/1 |
| 3,630,496 | * | 12/1971 | Hurst | 415/26 X |
| 4,158,527 | * | 6/1979 | Burkett | 415/1 X |
| 4,164,033 | * | 8/1979 | Glennon et al. | 415/17 X |
| 4,203,701 | * | 5/1980 | Abbey | 415/1 |
| 4,405,290 | * | 9/1983 | Rannenberg | 415/27 X |
| 4,464,720 | * | 8/1984 | Agarwal | 415/1 X |
| 4,586,870 | * | 5/1986 | Hohlweg et al. | 415/1 |
| 4,656,589 | * | 4/1987 | Albers et al. | 415/1 X |
| 4,789,298 | * | 12/1988 | Blotenberg | 415/27 |
| 4,831,534 | * | 5/1989 | Blotenberg | 415/1 X |
| 4,831,535 | * | 5/1989 | Blotenberg | 415/1 X |
| 4,948,332 | * | 8/1990 | Blotenberg | 415/27 |
| 5,195,875 | * | 3/1993 | Gaston | 415/27 X |
| 5,426,975 | | 6/1995 | Stark . | |
| 5,586,861 | * | 12/1996 | Berger | 415/118 |
| 5,743,715 | * | 4/1998 | Staroselsky et al. | 415/1 X |

FOREIGN PATENT DOCUMENTS

| | | |
|---|---|---|
| 34 02 120 | 7/1985 | (DE) . |
| 37 03 401 | 8/1988 | (DE) . |
| 0 419 798 | 4/1991 | (EP) . |

* cited by examiner

*Primary Examiner*—John E. Ryznic
(74) *Attorney, Agent, or Firm*—Herbert Dubno

(57) ABSTRACT

Fore many applications it is desirable to determine the operating level, i.e. the current flow rate V and the total pressure difference $\Delta p_t$ of a fan in the installed state without external measuring points and calibration. The invention should develop a suitable method and a corresponding fan.

In the method of the invention, from a measured effective pressure difference $\Delta p^M_w$ a flow rate V is determined and from that, via an operational characteristic curve a target value for the total pressure difference $\Delta p^s_t$ is found. By comparing the target value $\Delta p^s_t$ determined this way with its measured value $\Delta p^M_t$ the operating level and its accuracy are determined. For this purpose on the fan of the invention measuring points are provided for measuring one or more effective pressure differences $\Delta p^M_w$ and the total pressure difference $\Delta p^M_t$.

13 Claims, 2 Drawing Sheets

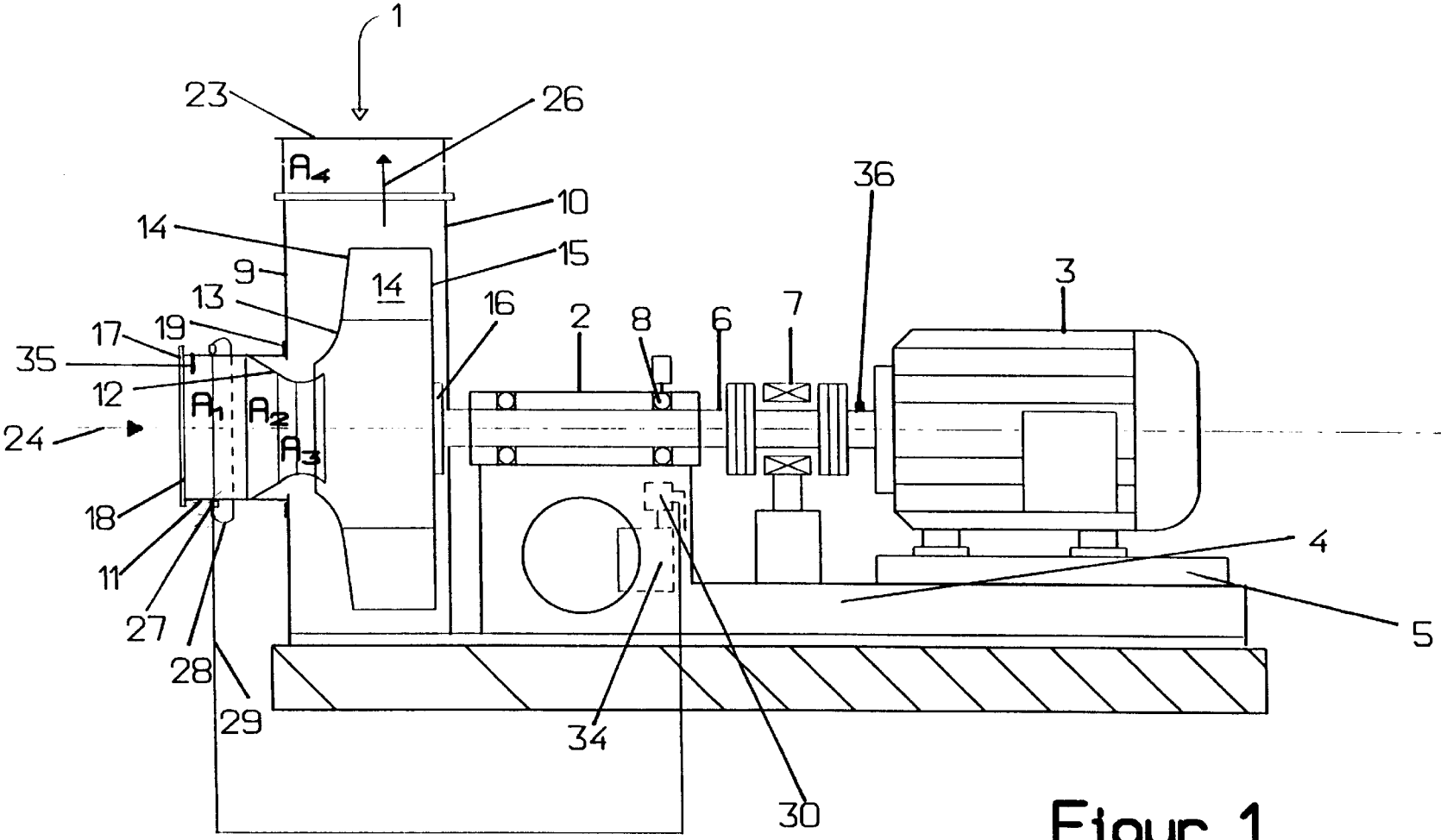
Figur 1

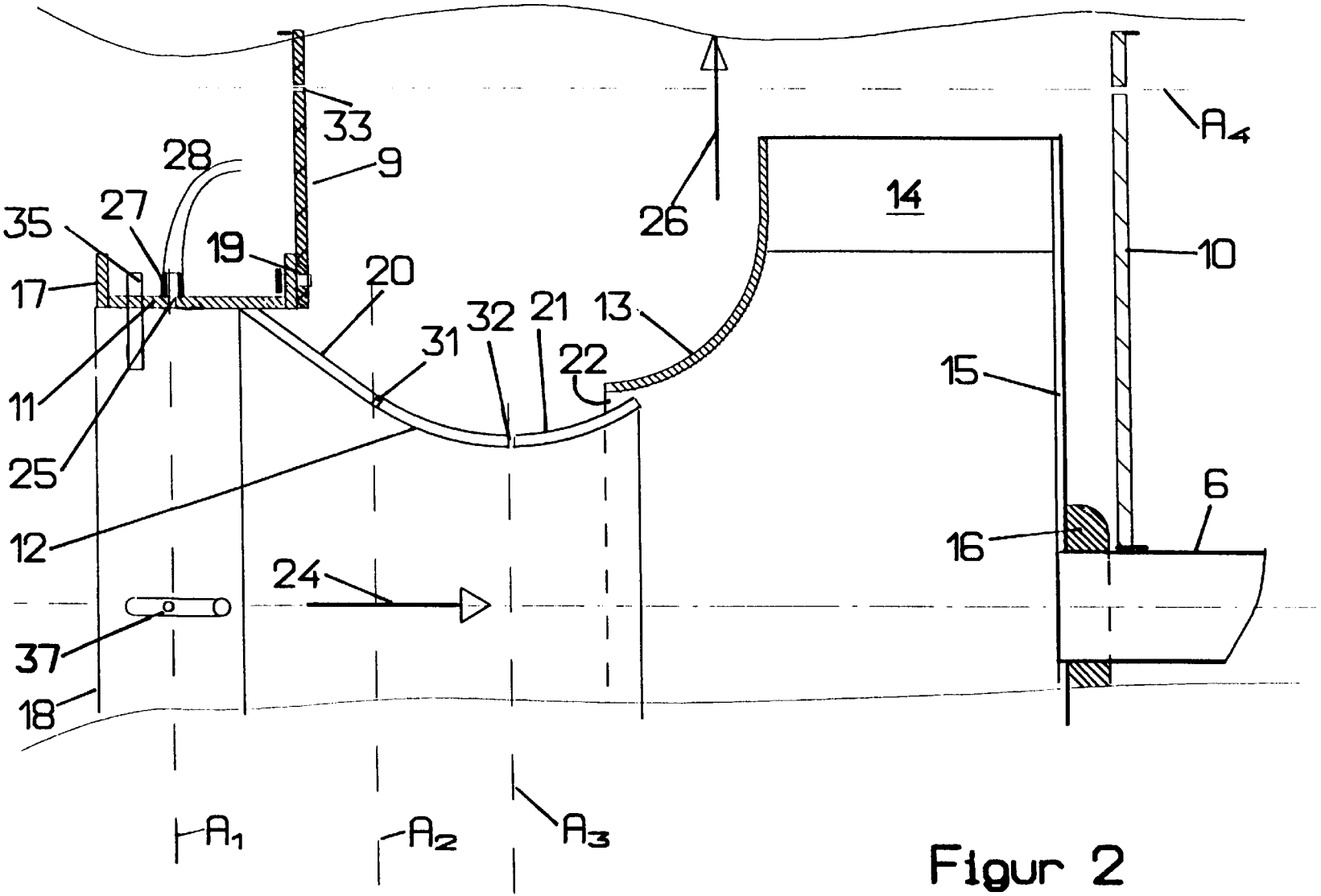
Figur 2

METHOD FOR DETERMINING THE OPERATING LEVEL OF A FAN AND FAN

FIELD OF THE INVENTION

The invention relates to a method for determining the operating level of a fan and a fan operated by that method.

BACKGROUND OF THE INVENTION

For many applications it is important to know the operating level, i.e. the flow rate V and the total pressure difference $\Delta p_t$ of a fan in its installed state. In refineries, in the chemical industry or in process technology the knowledge of the flow rate V is a requisite for establishing the material balance. In nuclear power plants fans and the like are integrated in the safety chain for keeping an underpressure. In the construction of installations and equipment, for instance in chip drying or the drying of plaster board, the knowledge of the operating levels of the fans improves the control of the installation or the equipment. When fans are used in building technology, the operating levels of the fans are needed for energy management. The conditions in the installed state do not allow for measuring methods which can be compared to measurements taken on the test stand.

A generic method and a generic device for determining the flow rate of a radial fan are known from EP-B 0 419 798. The radial fan has at least one inlet nozzle defining a cross flow opening and arranged upstream of the radial fan wheel. At least partially at one measuring point in the area of the inner periphery of the inlet nozzle and namely in the area preceding its cross flow opening a measuring device is arranged which is designed as a static pressure measuring device and connected via an opening in the nozzle wall close to the measuring point.

The static pressure prevailing in front of the cross flow opening of the inlet nozzle is measured with the static pressure measuring device at the measuring point and compared to the static pressure prevailing in the fan surroundings. The pressure difference $\Delta p$ is proportional to the square of the flow rate V. From the measured difference of the pressures $\Delta p$ the flow rate V is calculated, and with the aid of the flow rate V the operating efficiency of an already installed fan can be established. The proportionality factor depends on the mounting situation, so that each time it is necessary to include a calibration curve. As a rule in installations there are rarely sufficient working sections for calibrations, since the tendency is to build these installations as compact as possible. A drawback of this method is that fan influx disturbances are not noted. This can lead to wrong interpretations of the measurement results.

OBJECT OF THE INVENTION

It is the object of the invention to provide a method and a corresponding fan which make it possible to determine the operating level in the installed state, i.e. without an external measuring section and calibration, as well as an estimate about the quality of this determination, and which insure a high degree of safety against failure and thereby a high operational safety.

SUMMARY OF THE INVENTION

According to the invention an effective pressure difference $\Delta p^M_w$ between two planes of the inlet nozzle or between a plane in the inlet nozzle and a point of the surroundings is measured, as well as a total pressure difference $\Delta p^M_t$ between the suction side and the pressure side of the fan, and the shaft power $P^M_w$. The shaft power $P^M_w$ is a good measure for the power exerted by the impeller for the displacement of the gas. Instead of the shaft power $P^M_w$ it is also possible to measure the motor power $P^M_M$ of the fan motor and to translate that measurement into the shaft power $P^M_w$. The flow rate V is determined from the pressure difference $\Delta p^M_w$ according to $$V=\alpha A\sqrt{((2/\rho)\Delta p^{M_w})} \quad (1)$$

whereby $\alpha$ is a nozzle coefficient composed by the cross flow coefficient $\alpha'$ and the expansion coefficient $\epsilon$, A the reference cross section of the inlet nozzle and $\rho$ the density of the propelled gas when entering the fan. Subsequently from an available operational characteristic curve $\Delta p(V)$ the target value of the total pressure difference $\Delta p^s_t$ is determined and compared with the measured total pressure difference $\Delta p^M_t$. Optionally the target value of the shaft power $P^s_w$ pertaining to the flow rate V is determined from an available operational characteristic curve $P_w(V)$ and compared with the measured shaft power $P^M_w$. Based on the coincidence or the deviations of the target values $\Delta p^s_t$ and $P^s_w$, the measured values $\Delta p^M_t$ and $P^M_w$ the operating level and its quality are determined. If one or both values coincide closely with their measured values, then the operating level determined from the flow rate V and the total pressure $\Delta p^M_t$ is established with high precision. A corresponding class of accuracy is assigned.

An advantage of the method according to the invention is that the operating level of the fan in the installed state can be determined along with an indication of the class of accuracy. Unfavorable afflux conditions are recognized when the operating level is determined and generally lead to the finding of less accurate values. Also with this method of determination of the operating level it is possible to detect unacceptable operating levels. It is also possible to detect hidden failures or total failures of the measured-value receivers, for instance through the addition of measuring points. False alarms are avoided and can be intercepted through qualified warnings.

The target values $\Delta p^s_t$ and $P^s_w$ can be established with the help of transmitted configuration values, such as nominal diameter D of the fan or measurements of the inlet nozzle and measured physical parameters, such as the outer pressure Pa, the temperature T, the rotary motor speed n or the rotary impeller speed n* and from the model characteristics. Model characteristics are characteristics which have been established during the testing of a fan model and have been standardized, i.e. they are standardized type characteristics. Model characteristics for the pressure coefficient $\psi(\phi)$, the efficiency $\eta(\phi)$ and optionally the power coefficient $\lambda(\phi)$ depending on the cross flow coefficient $\phi$, are recorded. Finding the target values $\Delta p^s_t$ and $P^s_w$ from the model characteristics $\psi(\phi)$ and $\eta(\phi)$ for the current installed state makes possible the use of a fan with an integrated, correspondingly programmed microcomputer and a system interface.

Additionally, with the method of the invention for the determination of the operating level, a physical parameter, for instance the density $\rho$ of the propelled gas can be determined, by measuring the shaft power $P^M_w$ in addition to an effective pressure difference $\Delta p^M_w$ between two planes in the inlet nozzle or between a plane of the inlet nozzle and a point in the surroundings, and the total pressure difference $\Delta p^M_t$. Thereby after finding the flow rate V and the corresponding value of the model characteristic $\psi(\phi)$, the physical parameter to be determined is found with the help of the value of the model characteristic $\psi(\phi)$ and optionally of configuration and physical parameters, as well as of the measured total pressure difference $\Delta p^M_t$. If, as in the case of the density ρ, the physical parameter to be found is necessary for determining the flow rate V, the determination of the flow rate V and of the physical parameter is performed in iteration steps. The comparison of the target value for the shaft power $P^s_w$ derived from the established flow rate V with its measured value $P^M_w$ makes possible the assignment of a class of accuracy.

In the determination of the flow rate V from the measured pressure difference $\Delta p^M_w$, it is possible to take into account the dependence of the nozzle coefficient α corresponding to this pressure difference $\Delta p^M_w$ on the Reynold's number Re in iteration steps. For this purpose at least one model characteristic curve α(Re) measured on a model inlet nozzle integrated in a model fan is recorded. In the determination of the flow rate V according to equation (1) in the first iteration step an average nozzle coefficient α is introduced. From the flow rate V found in the first iteration step a Reynold's number Re can be found and from the model characteristic curve α(Re) a second nozzle coefficient α can be read. The second iteration step is performed with the second nozzle coefficient α. Iteration steps follow until the flow rate V and the nozzle coefficient α do not change in a subsequent iteration step, i.e. until the deviations of the values of following iteration steps remain within predetermined limits. The consideration of the dependence of the nozzle coefficient α from the Reynold's number Re recorded in a model characteristic curve α(Re), and thereby from the flow rate V, is particularly advantageous for small Reynold's numbers Re, whereby a strong dependence of the nozzle coefficient α(Re) on the Reynold's number was measured. This makes possible a more accurate determination of the operating level, and the assignment of a better class of accuracy.

In the determination of the target values of the total pressure difference $\Delta p^s_t$ and the shaft power $P^s_w$, the values found through the characteristic curve in the form of factors depending on the operating parameters of the fan, particularly the factor k for taking into consideration internal losses and/or the factor f for taking into consideration the densifying of the propelled gas, can be upgraded or downgraded. For this purpose for instance measured characteristic curves are recorded for several models of the type range of the fan for the factor k depending on the rotational speed u of the fan wheel and characteristic curves or calculation instructions for the factor f depending on the total pressure difference $\Delta p_t$. The consideration of this up or downgrading leads to an even more accurate determination of the operating level and is necessary for assigning a higher class of accuracy.

A measurement of two effective pressure differences $\Delta p^M_{w1/3}$ and $\Delta p^M_{w2/3}$ in the inlet nozzle makes it possible to check the quality of flow and of the measuring points. The checking of the flow quality takes place through a comparison of the ratios of the pressure differences $\Delta p^M_{w1/3}$ and $\Delta p^M_{w2/3}$ with the known value of the square of the mutual ratio of the corresponding nozzle coefficients $(\alpha_{2/3}/\alpha_{1/3})^2$. The determination of the operating level can be performed with any of the two pressure differences $\Delta p^M_{w1/3}$ and $\Delta p^M_{w2/3}$ by using the cross-flow coefficients $\alpha_{1/3}$ and $\alpha_{2/3}$ which have been found in the model of a fan with inlet nozzle and recorded. The thereby occurring differences indicate faulty measuring points.

By measuring the pressure differences in a plane A1 to A4 at four measuring points, the average value can be used for the determination of the fan operating level.

With the aid of a measurement of the static pressure in the center of the planes which are involved in measuring the effective pressure difference the character of the oncoming flow can be evaluated by comparing the pressure measured at the center and at the inlet nozzle and considered in the assignment of a class of accuracy. If the pressure is lower in the center than at the inlet nozzle, then the flow is afflicted by swirling.

A fan can have a motor, an impeller, a housing, an inlet nozzle with at least one pressure measuring point and a device for processing the measured values, for instance a microcomputer. The fan can have measuring points for measuring one or more effective pressure differences $\Delta p^M_w$, measuring points for measuring the total pressure $\Delta p^M_t$ and a power measuring device measuring the shaft power $P^M_w$ of the fan. It thus is possible to compare measured values $\Delta p^M_t$ and $P^M_w$ with the target values $\Delta P^s_t$ and $P^s_w$ established through the operational characteristic curves $\Delta p_t(V)$ and $P_w(V)$, which have been established from the measured effective pressure difference $\Delta p^M_w$ and the derived flow rate V.

For the determination of the physical parameters the fan has simple measuring devices, namely a device measuring the number of rotations per minute, a temperature sensor and an absolute pressure sensor.

The inlet nozzle can have a further plane A2 with pressure measuring points and in each of planes A1 to A3 in the inlet nozzle of the radial fan and in the plane A4 in the housing there are four pressure measuring points arranged peripherally. The four measuring points are connected to each other for instance by means of a ring conductor. The ring conductors are connected with corresponding pressure sensors.

In the center of planes A2 and A3 static pressure detecting points are arranged, for instance in each a static pressure probe fastened to three struts.

BRIEF DESCRIPTION OF THE DRAWING

FIG. 1 is a side view of an arrangement of a radial fan of the invention, with its motor, seen in a vertical section through a housing and a support along the rotation axis; and FIG. 2 is a section through the radial fan which is perpendicular to the axis of rotation.

SPECIFIC DESCRIPTION

In order to clarify the arrangement of measuring points in the inlet nozzle, in FIG. 1 and to a larger extent in FIG. 2, the inlet nozzle has been stretched somewhat parallel to the rotation axis of the fan wheel.

FIG. 1 shows a radial fan 1 with unilateral suction with a support 2 and a motor 3. The support 2 is fastened to a plate of the base frame 4 provided with an opening and shaped like a bearing block and the motor 3 is fastened on this base frame 4 by a motor plate 5.

A drive shaft 6 originating from motor 3 is interrupted by a torque measuring device 7 flanged on both sides for measuring the shaft power $P^M_w$. After the torque measuring device 7, the drive shaft 6 is guided through the bearing 8 of the support 2.

The radial fan 1 has a housing from which a lid-locking plate 9 and an opposite lateral wall 10 can be seen from FIGS. 1 and 2, a rearward elongated inlet nozzle with an outer pipe segment 11 and an inner nozzle segment 12 and a fan wheel with a cover plate 13, blades 14, a hub plate 15 and a hub 16. The drive shaft 6 guided through the bearing 8 is inserted in this hub 16 with a snug fit.

The pipe segment 11 has an outer connection flange 17 which defines the inlet opening 18 and whose outer diameter is also known as the nominal diameter of the radial fan, and an inner connection flange 19 by means of which the inlet nozzle is fastened to the lid-locking plate 9. As can be clearly seen in FIG. 2, the nozzle segment 12 of the inlet nozzle is slightly pushed into the pipe segment 11 towards its inner end pointing towards the fan wheel, and is connected with the former by seamless welding. While its inner connection flange 19 is being fastened, the inlet nozzle is centered on the cover plate 13 of the fan wheel and thereby on the fan wheel.

Starting from the pipe segment 11, the nozzle segment 12 of the inlet nozzle has an intake taper 20 (FIG. 2) and a circular arc section 21, which forms a nozzle neck and a diffuser and whose narrowest diameter is located somewhat in the center. The axial extension of the intake taper 20 is approximately half as big as the circular arc section 21. The intake taper 20 closes the circular arc section 21 tangentially.

The inner end of the circular arc section 21 of the nozzle segment 21 projects into the cover plate 13. Between the circular arc section 21 of the nozzle segment 12 and the cover plate 13 remains a small surrounding air gap 22, which remains constant due to the centering of the inlet nozzle with the cover plate 13.

The housing of the radial fan has a rectangular outlet opening 23 (FIG. 1), which is arranged perpendicularly to the inlet opening 18 and is bordered by the lid-locking plate 9 and the lateral wall 10, as well as by a not illustrated housing jacket. The cross section surfaces of the rectangular discharge opening 23 and of the round intake opening 18 are of equal size.

In the outer half of the pipe segment 11 of the inlet nozzle, in a plane A1 perpendicular to the intake direction 24, four throughgoing bores 25 are distributed peripherally. The positions of the throughgoing bores 25 (FIG. 2) are oriented depending on the blowout direction 26. The throughgoing bores 25 are either parallel to the blowout direction 26 or perpendicular thereto. The throughgoing bores 25 can also be arranged so that a peripheral segment of the inlet nozzle extending over an angle of 60°, measured against the spiral opening originating from the radial axis or line crossing the longitudinal axis of the housing exit at a right angle, extending radially with respect to the longitudinal nozzle axis, remains free of throughgoing bores.

The diameter of the throughgoing bores equals 2 to 4 mm, here 3 mm. Towards the inner wall the throughgoing bores 25 have sharp edges and are deburred. On the outside the pipe nipples 27 which are connected with the pipe segment 11 in a gas-proof manner project over the throughgoing bores 25. The outer diameter of the pipe nipples 27 amounts for instance to 6 mm. The four pipe nipples 27 are interconnected by a ring conductor 28. A connection conductor 29 leads from the ring conductor 28 to a pressure sensor 30, arranged outside the inlet nozzle, namely on the base frame 5 below the support 2 between the two plates, in a protected location.

In the nozzle segment 12 in a plane A2 parallel to plane A1, which is located in the intake taper 20 in the vicinity of the transition towards the circular arc section 21, and in a plane A3 at the narrowest diameter of the circular arc section there are also four throughgoing bores on each, respectively 31, 32, peripherally arranged at the same angles as the throughgoing bores 25. These throughgoing bores 31, 32 are each provided with pipe nipples, a ring conductor, a connection conductor. The pipe nipples, the ring conductor and the connection conductor are not shown in the drawing.

The connection conductor of the throughgoing bores 32 of plane A3 is also connected to the pressure sensor 30 designed as a differential pressure sensor. Close to the pressure sensor 30, there is another pressure sensor (not shown in the drawing) which is also designed as a pressure difference sensor, to which the connection conductor of the throughgoing bores 31 of the plane A2 and the connection conductor of the throughgoing bores 32 of the plane A3 are connected.

In a plane A4 perpendicular to the blowout direction 26 and close to the discharge opening 23 (in the straight end area of the housing jacket), four further throughgoing bores 33 evenly distributed at the periphery are arranged, provided with pipe nipples, a ring conductor and a connection conductor. The pipe nipples, the ring conductor and the connection conductor are not shown in the drawing. The connection conductor is connected to a pressure sensor (not shown in the drawing) located close to pressure sensor 30 and designed as a differential pressure sensor. The connection conductor of the throughgoing bores 25 of plane A1 is also connected to this pressure sensor.

Close to the pressure sensor 30 an absolute pressure sensor (not shown in the drawing) for measuring the surrounding pressure Pa is arranged. In this protected area a switch box 34 is arranged, wherein a microcontroller, devices for signal conditioning, such as frequency converters and amplifiers, and a power supply, i.e. a battery, are located. The microcontroller is connected via a BUS-circuit with a data-processing device, for instance a PC. The pressure sensors 30 connected to the planes A1 and A4 and the absolute pressure sensor for measuring the surrounding pressure Pa are connected with the signal conditioning devices connected to the microcontroller.

In the pipe segment 11 in the inlet nozzle a temperature sensor 35 and on the drive shaft 6 a rotational speed sensor 36 are arranged, each being connected through a line via the interface with the microcontroller in the switch box 34. The rotational speed sensor 36 can also be arranged on the impeller of the radial fan 1. The torque measuring device is also connected via a conductor (not shown in the drawing) and the interface with the microcontroller. The nominal diameter D of the radial fan 1 is 800 mm, the diameter of the outer connection flange 17 is 800 mm, its inner diameter is 788 mm, the narrowest diameter of the nozzle segment 11 is 577 mm, the diameter of the cover plate 12 of the fan wheel is 629 mm, the axial length of the pipe segment 10 of the inlet nozzle is 180 mm and the length of the nozzle segment 12 is 261 mm. The circular arc section 20 corresponds to a circular arc of 72° with a radius of 150 mm. The angle between the pipe segment 10 and the intake taper 19 of the nozzle segment 11 is 36°. The area ratios A1:A2:A3 equal 1:0.81:0.52.

In the center of each of the planes A1 to A3 static pressure reading points are arranged, whereof only the static pressure reading point 37 of plane A1 is shown in FIG. 2. The static pressure reading point 37 is designed as a static pressure probe fastened on three struts.

The memory of the microcontroller contains standardized operational characteristic curves $\psi(\phi)$, $\eta(\phi)$, and optionally also $\lambda(\phi)$, which are also known as model characteristic curves for the type range of radial fan 1. In these relations, $\phi$ is the cross-flow coefficient, $\psi(\phi)$ the pressure coefficient, $\eta(\phi)$ the efficiency degree and $\lambda(\phi)$ is the delivery coefficient. The typical characteristic curves have been derived from the characteristic curves found by testing a geometrically similar radial fan model, for instance with a nominal diameter of 400 mm. Besides the memory of the microcontroller includes dimensionless nozzle coefficients $\alpha(Re)$ dependent on the Reynold's number Re for pressure differences between the planes A1 and A3 and between the planes A2 and A3, thereby providing characteristic curves for the inlet nozzle. These cross-flow coefficients $\alpha(Re)$ have been derived from measurements on a geometrically similar inlet nozzle integrated in the model radial fan.

Characteristic curves for the factor k for consideration of internal losses dependent on the rotational speed of the radial fan 1, which have been measured in several sizes of the type range of radial fan 1, as well as calculation instructions for the factor f for considering the densification of the conveyed gas depending on the total pressure difference $\Delta p_t$, are recorded.

The memory of the microcontroller further contains configuration values, such as the nominal diameter D (800 mm), the integration situation, the gas type and load of solids.

In a variant of a radial fan according to the invention, instead of four throughgoing bores the planes 1, 2, 3 and 4 can each be provided with a single throughgoing bore. In order to avoid their clogging with condensation water, in the planes 1, 2 and 3 these throughgoing bores should be arranged in the upper half of the inlet nozzle.

In a method for the determination of the operating level according to the invention, at first the measured values for the pressure difference $\Delta p^M_{w1/3}$, optionally the pressure difference $\Delta p^M_{w2/3}$, the total pressure $\Delta p^M_t$ and the shaft power $P^s_w$, as well as the measured values characterizing the currently existing conditions, for instance the external pressure Pa, the temperature T, the rotational speed n of the motor 3 or of the fan wheel n*, are obtained.

The measured values for the shaft power $P^M_w$ are calculated from the measured torque $M^M$, if there is a torque-measuring device 7.

If in addition to the first pressure difference $\Delta p^M_{w1/3}$ in the inlet nozzle also a second pressure difference $\Delta p^M_{w2/3}$ is measured, then the ratio of the pressure differences $\Delta p^M_{w1/3}/\Delta p^M_{w2/3}$ can be compared with the square of the mutual ratio of the corresponding nozzle coefficients $(\alpha_{2/3}/\alpha_{1/3})^2$. A coincidence within +−10% indicates a sufficiently undisturbed incoming flow in the inlet nozzle and functioning measuring points, i.e. clear throughgoing bores 25, 31, 32.

In this example the flow rate V is determined as per equation (1) from the effective pressure difference $\Delta p^M_{w1/3}$. According to the effective pressure method it will be:

$$V=\alpha_{1/3}A3\sqrt{((2/\rho)\Delta p^M_{w1/3})} \quad (1a)$$

whereby $\alpha_{1/3}$ is the nozzle coefficient for the flow ratio between the planes A1 and A3 in the inlet nozzle, A3 the cross section of the inlet nozzle in the measuring plane A3 and $\rho$ the density of the propelled gas. A3 is known as one of the configuration values. The density $\rho$ can be determined from the temperature T measured in the inlet nozzle during air transport and the measured external pressure Pa.

The flow rate V could also be determined from the pressure difference $\Delta p^M_{w2/3}$ with the corresponding nozzle coefficient $\alpha_{1/3}$.

The dependence of the nozzle coefficients $\alpha_{1/3}$ and $\alpha_{2/3}$ on the Reynold's number Re can be considered, in that the determination of the flow rate V starts out with an average nozzle coefficient $\alpha$, then from the found flow rate V a Reynold's number Re is calculated, and the pertaining nozzle coefficient $\alpha$ is taken up anew for the determination of the flow rate V. For the calculation of the Reynold's number Re the configuration values inlet cross section $A_D$, nominal diameter D, as well as the viscosity v of the propelled gas, in this case air, are needed. After a few iteration steps, coinciding values are obtained for the flow rate V and the corresponding nozzle coefficient $\alpha$.

From the flow rate v determined this way, with the help of the configuration value inlet cross section $A_D$, as well as from the situation value of the rotational speed n of motor 3 or of the speed n* of the fan wheel, and the rotational speed u determined with the help of further configuration values, it is possible to determine the cross-flow coefficient $\phi$ and from the characteristic curves of the model the pressure coefficient $\psi(\phi)$ For the consideration of the internal losses depending on current operational conditions of the radial fan and/or the densification of the propelled gas, for the accurate determination of the operating level, the values of the model characteristic curves can be up or downgraded. For the consideration of the internal losses the measured dependence of an up- respectively downgrading factor k (<or >1) of a magnitude depending on the rotational speed u of the fan wheel, the nominal diameter D and the viscosity v, is involved. For the consideration of the densification of the propelled gas an up- or downgrading factor f depending on the total pressure difference $\Delta P^M_t$ is involved.

With the help of the factors k and f determined this way the value $\psi$ of the pressure coefficient derived from the characteristic curve of the model $\psi(\phi)$ is up- or downgraded and used for the determination of the target value of the total pressure difference $\Delta p^s_t$, according to equation (2). For this purpose the density $\rho$ as well as the rotational speed u of the fan wheel are needed.

$$\Delta p^s_t=k\,f\psi(p/2)u \quad (2)$$

This total pressure difference $\Delta p^s_t$ is compared with the measured total pressure difference $\Delta p^M_t$. In case of a good coincidence <=2% it can be concluded that the operational level, i.e. the flow rate V and the total pressure difference $\Delta p^M_t$ are associated with a high class of accuracy.

If the shaft power $P^M_w$ of the radial fan was also measured, from the found flow rate V and the therefrom derived pressure coefficient $\phi$ a value for the efficiency degree $\eta(\phi)$ can be read from the characteristic model curve. This value can also optionally be up- or downgraded through the factors k and f. The target value for the shaft power $P^s_t$ results from the flow rate V, the total pressure difference $\Delta p^M_t$, the value for the efficiency degree $\eta(\phi)$ and optionally from the factors k and f. This value $P^s_w$ is compared with the measured shaft power $P^M_w$ for the evaluation of the quality of the operating level determination.

If the power is measured with a torque-measuring device, then the measured torque $M^M$ is converted into the shaft power $P^M_w$. A good coincidence (<2% deviation) indicates a high precision class.

Instead of a torque-measuring device 7 it is also possible to use a measuring device for the current consumption $I^M$ of the motor 3, the supply voltage U and the power factor cos $\phi$. The measured value for the motor power $P^M_M$ is calculated from the current consumption $I^M$ of the motor 3, the voltage U, the power factor cos $\phi$ and the efficiency degree $\eta_m$ of the motor 3 and then converted to the shaft power $P^M_w$ with the aid of an also recorded efficiency degree $\eta_a$. Due to the fact that the efficiency degrees $\eta m$ are only approximately known, when exclusively the measured value and the target value $P^M_w$ and $P^s_w$ coincide, only a low accuracy class can be assigned.

A method according to the invention for the determination of the operating level and of a current condition value, namely the density $\rho$ of the propelled gas, differs from the previously described method in that the determination of the flow rate V and of the density ρ is performed in several iteration steps with the help of one of the pressure differences $\Delta p^M_{w1/3}$ or $\Delta p^M_{w2/3}$ and the total pressure difference $\Delta p^M_t$. In the first iteration step one starts with an initial density ρ, calculated for instance from the temperature T and the external pressure Pa. The dependence of the nozzle coefficient $\alpha_{1/3}$ or $\alpha_{2/3}$ from the Reynold's number Re is considered by iteration in each of the iteration steps.

As a result a flow rate V, a corresponding cross-flow coefficient ϕ, factors k and f and the density ρ are obtained, from which optionally the air humidity can be calculated. In order to evaluate the quality of this result, as already described, the shaft power $P^s_w$ is determined from the available values and compared with the measured shaft power $P^M_w$ and a class of accuracy is assigned.

In the following several installation examples of the radial fan according to the invention are described. The installation conditions are not illustrated in the drawing.

Installation Example 1

A radial fan according to the invention with a nominal diameter 800 nm is here integrated in an installation aspirating the dust of a planing and grinding production line. The inlet nozzle of the radial fan is flanged to a straight pipe segment with a diameter of 800 mm and a length of 5 m. In front of the discharge opening 23 there is a rectangular channel, to which a pipe with an adjusting shutter is connected, which leads to a filter via a transition element.

Instead of a torque-measuring device, the radial fan has a measuring device for the motor power $P^M_M$ with devices for measuring the current J of the voltage U and the power factor cos ϕ. For the determination of the measured shaft power $PM_w$, the configuration value efficiency degree $\eta_m$ of the motor 3 and the efficiency degree $\eta_a$ are additionally stored in the microcontroller.

In operation the following measured values are available:

the surrounding pressure Pa, the temperature T in the inlet nozzle, the rotational speed n* of the fan wheel, the differential pressure $\Delta p^M_{w1/3}$ between the planes A1 and A2, the differential pressure $\Delta p^M_{w2/3}$ between the planes A2 and A3, the total pressure difference $\Delta p^M_t$ between the planes A1 and A4, the current consumption $I^M$ of the motor 3, the supply voltage U of the motor 3 and the power coefficient cos ϕ.

The installation situation of this radial fan 1 with a pipe segment with a length which is more than 5 times (5 m) bigger than the inlet diameter (0.8 m) appears to indicate an even oncoming flow. A check of the intake flow by comparing the ratios of the differential pressures $\Delta p^M_{w1/3}/\Delta p^M_{w2/3}$ with the known square of the mutual ratio of the corresponding nozzle coefficients $(\alpha_{2/3}/\alpha_{1/3})^2$ can be additionally performed for checking the measuring points.

The flow rate V is determined according to equation (1) from the differential pressure $\Delta p^M_{w1/3}$, whereby the density ρ needed for this is calculated from the measured temperature T and the measured external pressure Pa. The dependence of the nozzle coefficient $\alpha_{1/3}$ on the Reynold's number Re found in the model characteristic curve is taken into consideration through an iterative determination of the flow rate V and the nozzle coefficient $\alpha_{1/3}$, starting with an average nozzle coefficient $\alpha_{1/3}$.

From this flow rate V, with the help of the configuration and situation values, the cross-flow coefficient ϕ is determined and from the model characteristic curve the pressure coefficient ψ(ϕ) is determined.

This value is up or downgraded through the found factors k and f and used for the determination of the target value of the total pressure difference $\Delta p^s_t$. This total pressure difference $\Delta p^s_t$ is compared with the measured total pressure difference $\Delta p^M_t$. The deviation between the two values equals 0.8%. For the transport of an uncontaminated gas flow , already on the basis of this coincidence, it can be concluded that the determination of the operating level is of a higher accuracy class.

In addition in this installation example, from previously determined cross-flow coefficient ϕ a value for the efficiency degree η(ϕ) is read from the model characteristic curve and up or downgraded through the factors k and f. From this value the target value of the shaft power $P^s_w$ is calculated and compared with the value for the shaft power $P^M_w$ determined from the measured current consumption $I^M$ with the aid of the operational voltage U, the power factor cos Φ, the efficiency degree $\eta_m$ of the motor and the efficiency degree $\eta_a$. The measured shaft power $P^M_w$ exceeds by 5.6% the target value of the shaft power $P^s_w$ derived from the flow rate V. The somewhat higher value of the measured shaft power $P^M_w$ could be explained by the additional transport of solids due to the planing and grinding dust.

Besides the determination of the measured shaft power $P^M_w$ via the current consumption M is less accurate, due to the only approximately known efficiency degree.

The slightly higher measured shaft power $P^M_w$ in comparison to the target value $P^s_w$ makes the good coincidence of the total pressure values $\Delta p^s_t$ and $\Delta p^M_t$ plausible. An accuracy class of 0 to 1 can be assigned to the determination of the operating level.

Installation Example 2

Determination of the operating level and of the density ρ.

A radial fan 1 according to the invention also with a nominal diameter of 800 mm is integrated in a drying installation for the transport of exhaust air to a heat exchanger. The mounting situation leads to an irrotational intake and discharge of the exhaust air , which has a variable steam content and a variable temperature T. The rotational speed n* of the fan wheel is set by a humidity controller or over a frequency changer. The radial fan 1 has a torque measuring device 7 and an electric current measuring device on its motor.

In operation there are the following measured values:

the surrounding pressure Pa, the temperature T in the inlet nozzle, the rotational speed n* of the fan wheel, the differential pressure $\Delta p^M_{w1/3}$ between the planes A1 and A2, the differential pressure $\Delta p^M_{w2/3}$ between the planes A2 and A3, the total pressure difference $\Delta p^M_t$ between the planes A1 and A4, the torque $M^M$, the current consumption $I^M$ of the motor 3, the supply voltage of the motor 3 and the power factor cos ϕ.

In this installation example for the testing of the intake flow and measuring points, at first the ratio between the differential pressures $\Delta p^M_{w1/3}/\Delta p^M_{w2/3}$ is compared with the known square of the mutual ratios of the corresponding nozzle coefficients $(\alpha_{2/3}/\alpha_{1/3})^2$. The two values coincide within 10%. Therefore it can be concluded that the measuring points function and the intake flow is irrotational, such as it is supposed to be in this installation situation.

The determination of the flow rate V and the therefor needed density ρ is performed from the differential pressure $\Delta p^M_{w1/3}$ with the aid of the total pressure difference $\Delta p^M_t$ in iteration steps, whereby in each iteration step the dependence of the nozzle coefficients $\alpha_{1/3}$ from the Reynold's number Re is iteratively considered.

In the first iteration step one starts with a value for the density ρ calculated from the temperature T and the surrounding pressure Pa. With the help of this value, from $\Delta p^M_{1/3}$ iteratively a value is calculated for the flow rate V and the nozzle coefficient $\alpha_{1/3}$. From the flow rate V the cross-flow coefficient ϕ is found and from the model characteristic curve the value of the pressure coefficient ψ(ϕ) is derived. Also the up and downgrading factors k and f are determined. With the aid of these values and the measured total pressure difference $\Delta p^M_t$ a value for the density ρ is calculated and the second iteration step is performed therewith. After a few iteration steps no further deviations are obtained in the values of the flow rate V and the density ρ.

In addition to the density ρ from which if needed the air humidity can be calculated, and the flow rate V, the determined value of the cross-flow coefficient ϕ is also obtained. From the value of the efficiency degree η(ϕ) derived therefrom, the already known factors k and f and the total pressure difference $\Delta p^M_t$, the shaft power $P^s_w$ is calculated and compared with the shaft power $P^M_w$ determined from the torque $M^M$. The measured value $P^M_w$ is only by 3.5% higher than the calculated $P^s_w$. This leads to the conclusion of an accurate determination of the flow rate V and of the total pressure difference $\Delta p^M_t$. The determination of the flow rate corresponds to the accuracy class of 0.

At the same time the measured shaft power $P^M_w$ is determined with the aid of a device for measuring the current consumption $P^M_M$ from the current consumption of motor 3 of the radial fan 1, the existing values operational voltage U and power factor cos ϕ and the configuration values efficiency degree $\eta_m$ of the motor 3 and the efficiency degree $\eta_a$. This measured value $P^M_w$ is approximately by 10% higher than the calculated value $P^M_w$. This deviation, as well as the less accurate determination of the measured shaft power $_{PMw}$ with the aid of a current measuring device would lead to the assignment of an accuracy class 2 for the determination of the operating level, for the case of an exclusive determination of the measured shaft power $_{PMw}$ with the aid of a current measurement $I^M$ and a determination of the motor power $P^M_M$.

Installation Example 3

In front of the inlet nozzle of a radial fan 1 according to the invention with a nominal diameter of 800 mm a 90° elbow is arranged.

In operation the following measured values are present:

the surrounding pressure Pa, the temperature T in the inlet nozzle, the rotational speed n* of the fan wheel, the differential pressure $\Delta p^M_{w1/3}$ between the planes A1 and A2, the differential pressure $\Delta p^M_{w2/3}$ between the planes A2 and A3, the total pressure difference $Ap^M_t$ between the planes A1 and A4, the current consumption ΔI, the supply voltage U and the power factor cos ϕ of the motor 3.

For checking the intake flow and the measuring points the ratio of the differential pressures $\Delta p^M_{w1/3}/\Delta p^M_{2/3}$ is compared with the square of the mutual ratio of the corresponding nozzle coefficients $(\alpha_{2/3}/\alpha_{1/3})^2$. The ratio between the differential pressures $\Delta p^M_{w1/3}/\Delta p^M_{2/3}$ is slightly higher than its target value, but lies within the tolerance range of ±10%. deviation. This can lead to the conclusion that the measuring points work. However a fully irrotational intake flow can not be assumed due to the elbow.

The flow rate V is determined from the differential pressure $\Delta p^M_{w1/3}$, whereby the dependence of the nozzle coefficient $\alpha_{1/3}$ was considered in iteration steps like in the preceding examples. From the flow rate V the cross-flow coefficient ϕ, the pressure coefficient ψ(ϕ), the up and downgrading factors k and f and finally the total pressure difference $\Delta p^s_t$ are derived. The measured value for the total pressure difference $\Delta p^M_t$ lies clearly below this calculated value $\Delta p^s_t$ (by approximately 8.9%).

Also the measured value of the shaft power $P^M_w$ determined from the current consumption $I^M$ is lower (by about 6.5%) than the target value $P^s_w$ for the shaft power, calculated from flow rate V, the cross-flow coefficient ϕ, the efficiency degree η(ϕ), the factors k and f and the total pressure difference $\Delta p^M_t$.

Since starting from the determined flow rate V, the determined total pressure difference $\Delta p^s_t$, as well as the determined power $P^s_w$ are higher than the measured values, it can be concluded that a changed flow profile of the intake flow due to the elbow arranged in front of the intake nozzle leads to these low measured values.

An accuracy class 2 is assigned to the operating level determined with the calculated flow rate V and the measured total pressure difference $\Delta p^M_t$, because of the inaccuracies due to the changed flow profile. Since both target values $\Delta p^s_t$ and $P^s_w$ are higher than their measured values, the flow can be described via characteristic curves displaced towards lower values. A higher precision in determining the operating level with V and $\Delta p^M_t$ is likely.

Installation Example 4

In front of the intake nozzle of a radial fan 1 according to the invention with a nominal diameter of 800 mm and a current measuring device, an intake duct with a sufficient length of an irrotational intake flow is arranged.

In operation the following values are present:

the surrounding pressure Pa, the temperature T in the intake nozzle, the rotational speed n* of the fan wheel, the differential pressure $\Delta p^M_{w1/3}$ between the planes A1 and A2, the differential pressure $\Delta p^M_{w2/3}$ between the planes A1 and A3, the total pressure difference $\Delta p^M_t$ between the planes A1 and A4, the current consumption $I^M$, the supply voltage U and the power coefficient cos ϕ of the motor 3.

For checking the intake flow and the measuring points, the ratio of the differential pressures $\Delta p^M_{w1/3}/\Delta p^M_{w2/3}$ is compared with the square of the mutual ratio between the corresponding nozzle coefficients $(\alpha_{2/3}/\alpha_{1/2})^2$. The ratio of the pressure differentials $\Delta p^M_{w1/3}/\Delta p^M_{w2/3}$ is by approximately 20% lower than its target value. Here it can be concluded that a disturbance exists.

From the flow rate V, which is determined from the differential pressure $\Delta p^M_{w1/3}$ and by considering the dependence of the nozzle coefficient $\alpha_{1/3}$ on the Reynold's number Re, the target values of the total pressure difference $\Delta p^s_t$ and the shaft power $P^M_w$ are calculated. A comparison with the measured values $\Delta p^M_t$ and $P^M_w$ shows that the two calculated values $\Delta p^M_t$ and $P^M_w$ are lower than the measured values $\Delta p^M_t$ and $P^M_w$. This indicates a flow rate V which is too low in the plane A3, probably due to clogging of a measuring point. Based on the measured values $\Delta p^M_t$ and $P^M_w$ and with the help of the model characteristic curve, an increased flow rate can be included. This determination of the operating level from the flow rate V and the measured total pressure difference $\Delta p^M_t$ is assigned an accuracy class of 3.

The flow rate V is also determined from the differential pressure $\Delta p^M_{w2/3}$. This flow rate V and the values derived therefrom for the total pressure difference $\Delta p^s_t$ and the power $P^s_M$ coincide well with the corresponding measured values $\Delta p^M_t$ and $P^M_w$. This determination is assigned the accuracy class 0 to 1. This information is recorded with a corresponding warning and optionally indicated.

A fan according to the invention can also be an axial fan with an intake nozzle or a comparable arrangement for measuring the effective pressure differentials $\Delta p^M_w$ and a draft probe. The determination of its operating level is performed only outside the unstable zone of its characteristic curves.

1 radial fan
2 support
3 motor
4 base frame
5 motor plate
6 drive shaft
7 torque measuring device
8 bearing
9 lid-locking plate
10 side wall
11 pipe section of inlet nozzle
12 nozzle section
13 cover plate
14 blades
15 hub plate
16 hub
17 outer connection flange
18 intake opening
19 inner connection flange
20 intake taper
21 circular arc section
22 air gap
23 discharge opening
24 intake direction
25 throughgoing bore A1
26 blowout direction
27 pipe nipple
28 ring conductor
29 connection conductor
30 pressure sensor
31 throughgoing bore A2
32 throughgoing bore A3
33 throughgoing bore A4
34 switch box
35 temperature sensor
36 rotational speed sensor
37 static pressure sampling location

What is claimed is:

1. A method of determining an operating level of a fan having an inlet nozzle, comprising the steps of:

a) measuring an effective pressure difference $\Delta p^M_w$ between two planes in the inlet nozzle or between a plane in the inlet nozzle and a location in the surroundings, a total pressure difference $\Delta p^M_t$ between an intake side and a pressure side of the fan, and a shaft power $P^M_w$ of a shaft driving the fan;

b) determining from the effective pressure difference $\Delta p^M_w$ the flow rate V by the relationship $$V=\alpha A\sqrt{((2/\rho)\Delta p^{M_w})} \quad (1)$$

where $\alpha$ is a nozzle coefficient, A is a cross sectional area of the nozzle and $\rho$ is the density of gas displaced by the fan;

c) comparing a target value of the total pressure difference $\Delta p^s_t$ found from the flow rate V via an operational characteristic curve $\Delta p_t(V)$ with the measured total pressure difference $\Delta p^M_t$;

d) comparing a target value $P^s_w$ for the shaft power found from the flow rate V via an operational characteristic curve $P_w(V$ with the measured power $P^M_w$; and e) from the comparisons c) and d) establishing an operating level of the fan and a degree of accuracy of the operating level.

2. The method according to claim 1 wherein the flow rate V and the target values of the operational characteristic curves $\Delta p^s_w$ and $P^s_w$ are determined from model characteristic curves $\psi(\phi)$, $\eta(\phi)$ and $\lambda(\phi)$, configuration values and values related to the currently existing conditions of the fan.

3. The method according to claim 2 wherein if in the determination of the flow rate V from the effective pressure difference $\Delta p^M_w$ a value of a currently existing condition to be determined is necessary, a determination of the flow rate V and of the currently existing values is performed through an iteration of steps b) to d).

4. The method according to claim 3 wherein in the determination of the flow rate V from the effective pressure difference $\Delta p^M_w$ the dependence of the nozzle coefficient $\alpha$ corresponding to this effective pressure difference $\Delta p^M_w$ from the Reynold's number Re is considered with a model characteristic curve $\alpha(Re)$ of the inlet nozzle in the installed state, through the iteration steps.

5. The method according to claim 1, wherein in the determination of the target value of the total pressure difference $\Delta p^s_t$ and the shaft power $P^s_w$, the values determined from the characteristic curves in the form of factors dependent on the operational conditions of the fan including a factor k for internal losses or a factor f for densification, are up or downgraded.

6. The method according to claim 1 wherein an effective pressure difference $\Delta p^M_{w1/3}$ between two planes and an effective pressure difference $\Delta p^M_{w2/3}$ between a plane, lying between the two planes, and one of the two planes are measured, whereby the flow rate V is determined from the effective pressure difference $\Delta p^M_{w1/3}$ or from the pressure difference $\Delta p^M_{w2/3}$ and from the ratio of the pressure differences the quality of the flow in the inlet nozzle and/or that of the measuring points is derived.

7. The method according to claim 1 wherein the pressure differences are measured at four measuring points distributed perpendicularly to the flow direction, each in a respective plane, and the measured pressure differences in each plane are averaged.

8. The method according to claim 1 wherein a static pressure is measured at the center of a respective plane in the inlet nozzle for in the measurement of the effective pressure differences.

9. A fan for the determination of its operating level and of a value of currently existing conditions, comprising a motor, a fan wheel, a housing, an inlet nozzle which is provided with at least one measuring point for measuring an effective pressure difference $\Delta p^M_w$ and with a thereto connected device for processing the measured values, wherein for measuring one or more effective pressure differences $\Delta p^M_w$, the inlet nozzle has at least one pressure measuring points in at least two planes (A1 and/or A2, A3) perpendicular to the flow direction, whereby the pressure measuring points of one plane (A1, A2, A3) are interconnected, and the pressure measuring point or pressuring measuring points of two planes (A1 and/or A2, A3) are connected to a pressure sensor (30), or the inlet nozzle has one or more pressure measuring points in at least one plane perpendicular to the flow direction and in one location in the surroundings a pressure measuring point is arranged, whereby the pressure measuring points of one plane are interconnected, and the pressure measuring point or pressure measuring points of a plane and the pressure measuring point in the surroundings are connected to a pressure sensor for the purpose of measuring a total pressure different $\Delta p^M_t$ a fan housing has several pressure measuring points in the vicinity of its discharge opening in a plane (A4) perpendicular to the blowout direction (26), whereby the pressure measuring points are interconnected, and the pressure measuring point or pressure measuring points are connected to a pressure sensor (30) connected to the pressure measuring points of the inlet nozzle of one of planes (A1 or A2, A3);

and for the purpose of measuring a shaft power $P^M_w$ a power measuring device is arranged on the fan.

10. A fan according to claim 9, further comprising a rotational speed meter (36) for measuring the motor speed n, a temperature sensor (35) in the inlet nozzle for measuring the temperature T and an absolute pressure sensor for measuring the surrounding pressure Pa.

11. A fan according to one of claim 9 wherein the inlet nozzle has in a further plane (A2) one or more pressure measuring points which are interconnected and are connected to a pressure sensor (30) connected to the pressure measuring points of the planes (A1, A3) of the inlet nozzle.

12. A fan according to one of claim 9 wherein in each of the planes (A1 to A4) of the inlet nozzle and the housing four evenly distributed pressure measuring points are arranged.

13. A fan according to one of claim 9 wherein in the center of each of the planes (A1, A2 or A3) with pressure measuring points, a static pressure sampling location (37) is provided.

* * * * *